United States Patent [19]

Jones

[11] 3,934,768

[45] Jan. 27, 1976

[54] GUN SUPPORT

[76] Inventor: Max E. Jones, 42398 Barbary St., Fremont, Calif. 94538

[22] Filed: Mar. 11, 1974

[21] Appl. No.: 449,975

[52] U.S. Cl. ..... 224/1 R; 224/5 A; 224/26 R

[51] Int. Cl.[2] ..... F41C 33/00

[58] Field of Search ..... 224/1 R, 1 A, 3, 5 E, 26 R, 224/26 B, 5 A, 5 B, 5 R

[56] References Cited

UNITED STATES PATENTS

| | | | |
|---|---|---|---|
| 3,501,074 | 3/1970 | Emerick | 224/1 R |
| 3,743,147 | 7/1973 | Wilczynski | 224/26 R |

FOREIGN PATENTS OR APPLICATIONS

| | | | |
|---|---|---|---|
| 56,690 | 12/1912 | Austria | 224/1 R |

*Primary Examiner*—Robert J. Spar
*Assistant Examiner*—Jerold M. Forsberg
*Attorney, Agent, or Firm*—Warren, Chickering & Grunewald

[57] ABSTRACT

A garment carried support member for a gun having an open top pocket dimensioned to receive the trigger guard of the gun and interior walls composed of elastomeric material contoured to mate with and provide a substantially continuous support for and resilient gripping of the outer periphery of the gun trigger guard.

3 Claims, 4 Drawing Figures

GUN SUPPORT

BACKGROUND OF THE INVENTION

1. Field of Invention

The invention relates to body worn devices such as slings and garment and belt constructions designed for assisting in the support of a rifle, shotgun or the like.

2. Description of Prior Art

Guns used by sportsment in hunting game are generally quite heavy and yet must be manually carried for protracted periods of time. The problem is considerably aggravated when hunting in cold climates. In such instances, the gun will be extremely cold and uncomfortable to touch, handle and carry, and the hunter will endeavor, when possible, to keep his hands in a warm and protected position within the folds or the pockets of his hunting jacket or other garment thus making the handling of his gun most difficult and awkward.

Various devices have been heretofore proposed for assisting the hunter in carrying his gun. Such devices have included an over the shoulder sling attached to the gun at a mid-point of its length, and clothing worn brackets having openings for receiving the gun trigger guard and providing a support for the gun adjacent to the guard. However, such prior devices have provided a relatively unsteady support for the gun, and have done little to improve the safety handling condition of the gun, as in moving through brush and the like.

SUMMARY OF THE INVENTION

An object of the present invention is to provide a gun support of the character described in which the gun will be firmly and securely carried in a most advantageous position for convenient and comfortable prolonged support by the hunter, and yet be immediately available for withdrawing from the holder for movement of the gun to shooting position.

Another object of the present invention is to provide a gun support of the character above which will insure complete enclosure of the gun trigger guard and the trigger therein making impossible the accidental displacement of the trigger while the gun is in supported position.

A further object of the present invention is to provide a gun support of the character described which is readily adaptable to a variety of types, makes and sizes of guns.

The invention possesses other objects and features of advantage, some of which of the foregoing will be set forth in the following description of the preferred form of the invention which is illustrated in the drawings accompanying and forming part of this specification. It is to be understood, however, that variations in the showing made by the said drawings and description may be adopted within the scope of the invention as set forth in the claims.

DETAILED DESCRIPTION OF INVENTION

Figure 4:
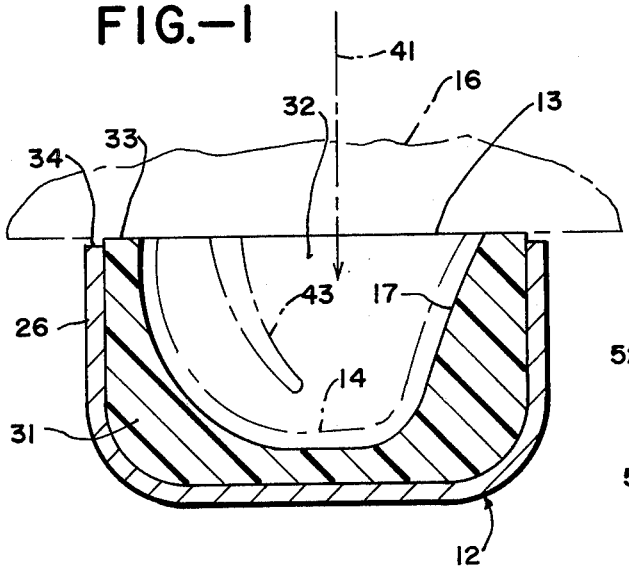
FIG. 4 is a cross-sectional view of the gun holder taken substantially on the plane of line 4—4 of FIG. 3.

Referring to the accompanying drawing, the gun support of the present invention comprises briefly a garment carried support member 11 and a pocket member 12 carried thereby and having an open top 13 dimensioned to receive the trigger guard of a gun 16 and having interior walls 17 composed of elastomeric material contoured, see FIG. 4, to mate with and provide a substantially continuous support for and resilient gripping of the outer periphery of trigger guard 14. Preferably support member 11 is composed of a sheet of relatively heavy material, such as leather or the like, which is folded and secured upon itself, see FIG. 3, to provide front and rear sides 18 and 19 and a passageway 21 therethrough dimensioned to receive a belt 22 therethrough for mounting of the support member at the front waist of the user, as seen in FIG. 1, the pocket member 12 being mounted on the front side 18, as seen in FIG. 3.

Figure 2:
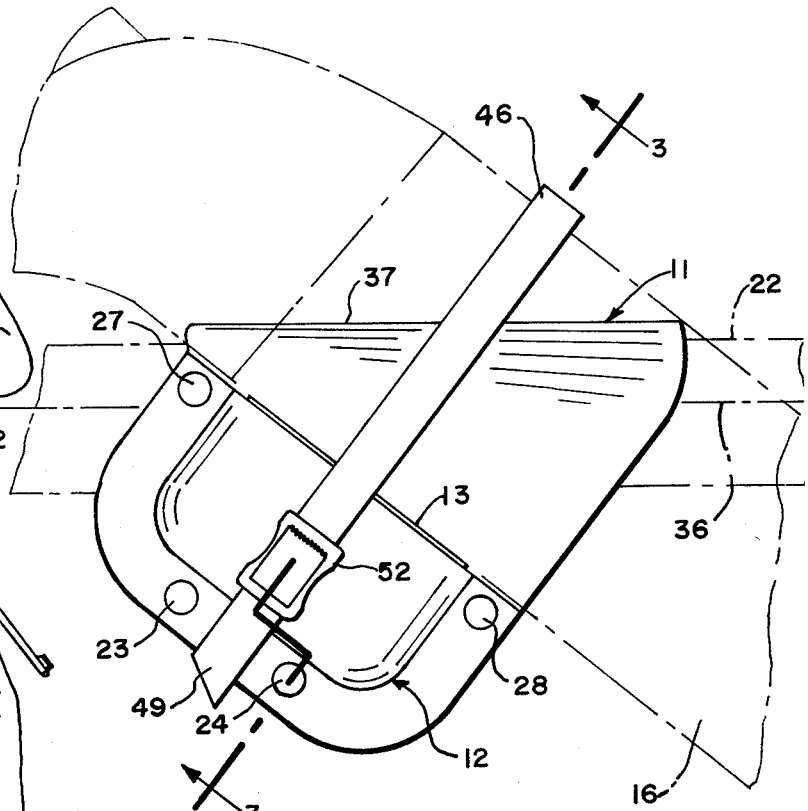
FIG. 2 is a front elevation, on an enlarged scale, of the gun holder.
Figure 3:
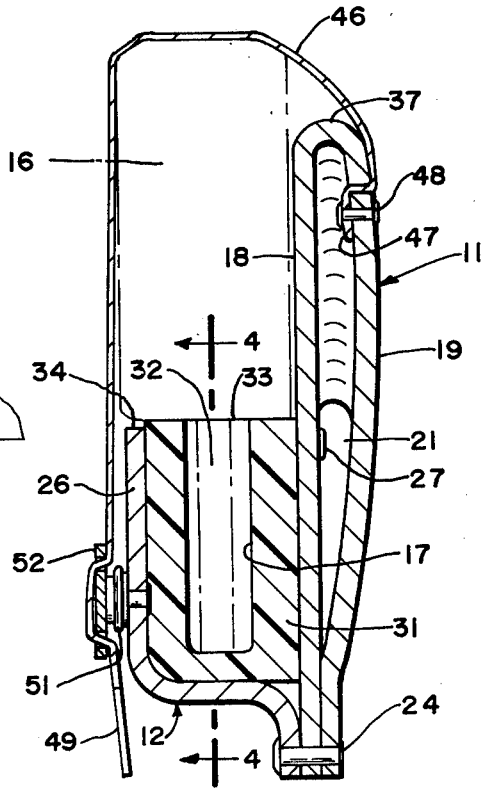
FIG. 3 is a cross-sectional view of the gun holder taken substantially on the plane of line 3—3 of FIG. 2.

With further reference to FIGS. 2, 3 and 4 it will be seen that support member 11 is formed by folding a leather or similar sheet upon itself and securing as by rivets 23 and 24 and/or by stiching; and the pocket member 12 here comprises an open top casing 26 fastened to the front side 18 of support member 11 by rivets 23, 24 and 28; and an elastomeric member 31 mounted in casing 26 for resiliently gripping the trigger guard 14 as above noted. Casing 26 is preferably formed of a relatively rigid sheet of material such as heavy leather or the like pressed into a cup shape as illustrated in FIGS. 2 and 3 and fastened to the front side 18 of the support member with the latter forming the back side of the pocket. As a feature of the present invention, the elastomeric member 31 is formed with a trigger guard receiving cavity 32 having an open top 33 registering with the open top 34 of casing 26 to form the open top 13 of the pocket member; and the elastomeric member 31 is formed as a demountable insert for positioning in casing 26, thus providing for interchangably mounting of a plurality of elastomeric members in one casing 26 for receiving and supporting different gun trigger guards of guns of different type, make and size while assuring full continuous resiliently gripping support for all of the trigger guards of the several guns for which insert members are customized.

Figure 1:
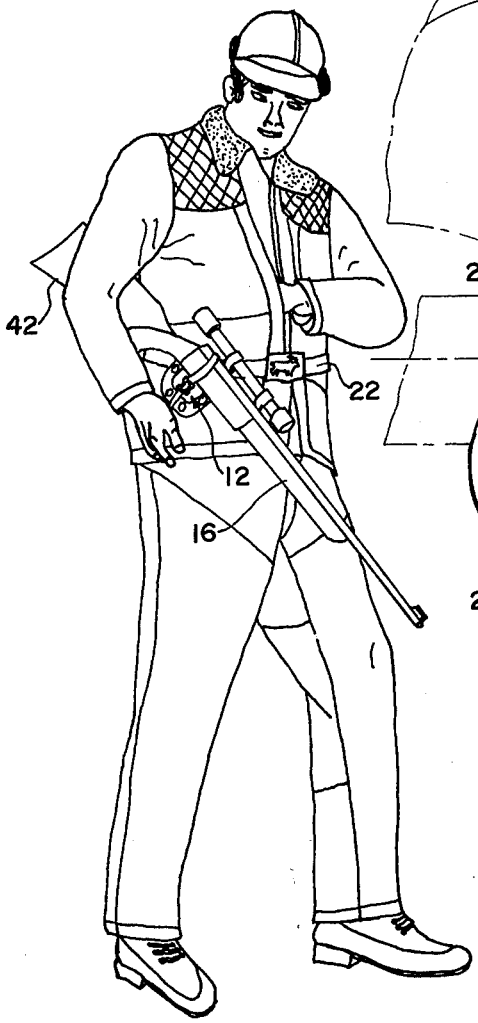
FIG. 1 is a perspective view of a gun holder constructed in accordance with the present invention and shown in operable position on a user and inoperable relation ot a gun carried thereby.

Another feature of the present invention is the angled orientation of the pocket member 12 on the support member, see FIG. 2, for most advantageously carrying the gun in a secure and balanced position and with the gun pointing downwardly forwardly of the user, see FIG. 1. As will be seen from FIG. 2, the belt passageway 21 has a support axis 36 parallel to the longitudinal dimension of belt 22 and generally parallel to the top fold 37 of the support member. On the other hand, pocket member 12 in angularly displaced on the front side 18 of the support member so that the entryway axis 41 to the trigger guard receiving cavity 32, see FIG. 4, generally perpendicular to open top 13, is angularly displaced, clockwise in FIG. 2, from the perpendicular to passageway axis 36. Accordingly, gun 16 when mounted in the present support will be rotated, clockwise as seen in FIGS. 1 and 2, to point the gun forwardly and downwardly of the user. This orientation of the gun also supports the gun near its center of mass and with the butt 42 rotated upwardly for convenient and comfortable cradling within the crook of the user's arm, as seen in FIG. 1. The gun may be supported in this position by the user over protracted periods of time without arm fatigue while the user's hands are free for positioning for warmth and comfort within the folds or pockets of the user's clothing. At the same time the full gripping peripheral support of the gun trigger guard will hold the gun in a very steady position with very little other effort being required to safely and conveniently carry the gun over all types of terrain and brush conditions. The complete enclosure of the gun trigger 43 within the cavity 32 of the elastomeric member insures complete safety. To further secure the gun in position, it will be noted that the top surfaces 33 and 34 of the elastomeric member and casing provide a rest surface for the gun adjacent to the trigger guard with such rest surface sloping downwardly, forwardly of the user. The upper end 33 of the elastomeric member may extend slightly above the adjacent end 34 of the casing, as seen in FIGS. 3 and 4, so as to provide an initial compression of the elastomeric member and cushioned support for the gun. Additionally, a retaining strap 46 may be secured to the support and pocket members for enveloping the gun carried by the support as depicted in the drawings. As here shown, one end 47 of strap 46 is secured to the rear side wall 19 of the support member by rivet 48 while the opposite end 49 is demountably attached to the front wall 26 by a snap 51 having one section riveted to front wall 26, see FIG. 3, and the attaching section carried by a buckle 52 slideably mounted on strap end 49.

As another feature of the present invention, the assembly when removed from the belt may be applied to the gun, as illustrated in FIG. 2, to provide a complete enclosure for the portion of the gun at the trigger guard and as a safety precaution during handling and storage of the gun.

What is claimed is:

1. In a gun support including a support member formed with a passageway therein dimensioned for mounting of said support member to a belt-like garment proximate the front waist of the user, said support member further being formed with a pocket having an open top dimensioned to receive the trigger guard of a gun therein, said open top being accessible for receipt of said trigger guard from a front side of said member, the improvement comprising:

an elastomeric member removably mounted in said pocket whereby a plurality of elastomeric members of similar external form may be interchangeably mounted in said pocket;

said elastomeric member having an interior wall defining an open top cavity mounted in registration with said open top of said pocket, said interior wall of said cavity being custom formed and contoured to mate with and provide a substantially continuous support for and resilient gripping of the outer periphery of the trigger guard of a particular gun whereby a plurality of elastomeric members may be interchangeably mounted in said pocket for support of any one of a plurality of guns; and said elastomeric member being formed to resiliently grip and support said trigger guard with sufficient force to provide substantially the sole support required for said gun to secure the same in an upright ready for use position proximate the front waist of the user.

2. The gun support as defined in claim 1, wherein said passageway in said support member being formed with an axis parallel to the longitudinal dimension of said belt-like garment; and the axis of entryway to said cavity being angularly displaced in a clockwise direction from the perpendicular to said passageway axis so as to support said gun in a forwardly, downwardly directed position.

3. The gun support as defined in claim 2, the top of said elastomeric member providing rest surfaces for said gun immediately fore and aft of said trigger guard.

* * * * *